United States Patent [19]

Walsh

[11] Patent Number: 4,944,543

[45] Date of Patent: Jul. 31, 1990

[54] ICE AUGER EXTRACTOR FOR RETRIEVING AUGERS OR SIMILAR DEVICES FROM A BORE HOLE

[75] Inventor: Michael R. Walsh, Weathersfield, Vt.

[73] Assignee: The United States of America as represented by the Secretary of the Army, Washington, D.C.

[21] Appl. No.: 172,890

[22] Filed: Mar. 25, 1988

[51] Int. Cl.[5] ..... E21B 31/12

[52] U.S. Cl. ..... 294/86.29; 294/86.3; 294/86.13

[58] Field of Search ..... 294/86.29, 86.27, 86.26, 294/86.25, 86.3, 86.31, 86.33, 86.13, 86.14, 86.16, 86.19, 86.1; 166/98, 99, 117.5, 117.6

[56] References Cited

U.S. PATENT DOCUMENTS

| | | | |
|---|---|---|---|
| 744,583 | 11/1903 | Meaders | 294/86.14 |
| 1,326,566 | 12/1919 | Boyd | 294/86.3 |
| 1,352,172 | 9/1920 | Brandon | 294/86.26 |
| 1,487,440 | 3/1924 | Butts | 294/86.26 |
| 1,530,253 | 3/1925 | Fox | 294/86.29 |
| 1,599,067 | 9/1926 | Segelhorst | 294/86.29 |
| 1,634,935 | 7/1927 | Donnelly | 294/86.3 |
| 1,745,274 | 1/1930 | Sauls | 294/86.33 |
| 1,754,816 | 4/1930 | Canniff | 294/86.26 |
| 1,780,017 | 10/1930 | Jurey | 294/86.13 |
| 1,906,895 | 5/1933 | Armstrong | 294/86.3 |
| 2,067,009 | 1/1937 | Hinderliter | 294/86.3 |
| 2,076,837 | 4/1937 | Grimmelsman | 294/86.3 |
| 2,103,611 | 10/1937 | Catland | 294/86.3 |
| 2,410,262 | 10/1946 | Breaux | 294/86.31 |
| 2,595,008 | 4/1952 | Sill | 294/86.3 |
| 2,671,686 | 3/1954 | Anderson | 294/86.13 |

*Primary Examiner*—Johnny D. Cherry
*Assistant Examiner*—Dean J. Kramer
*Attorney, Agent, or Firm*—Darrell E. Hollis

[57] ABSTRACT

An ice auger extractor for retrieving augers or similar devices from a bore hole includes a cylindrical housing and a spring-biased locking cam positioned in a vertically extending recess. The recess is substantially L-shaped and extends in a portion of periphery of the housing. The cam includes a serrated edge which secures the auger rod within the bore of the housing before its retrieval. A bore adapter may be connected with the housing and includes a substantially L-shaped snagging hook for centering the auger rod in the situation where the free end of the auger rod is embedded in the wall of bore hole. The housing and the bore adapter both include frusto-conical surfaces for guiding the auger rod into the housing.

5 Claims, 2 Drawing Sheets

FIG 1
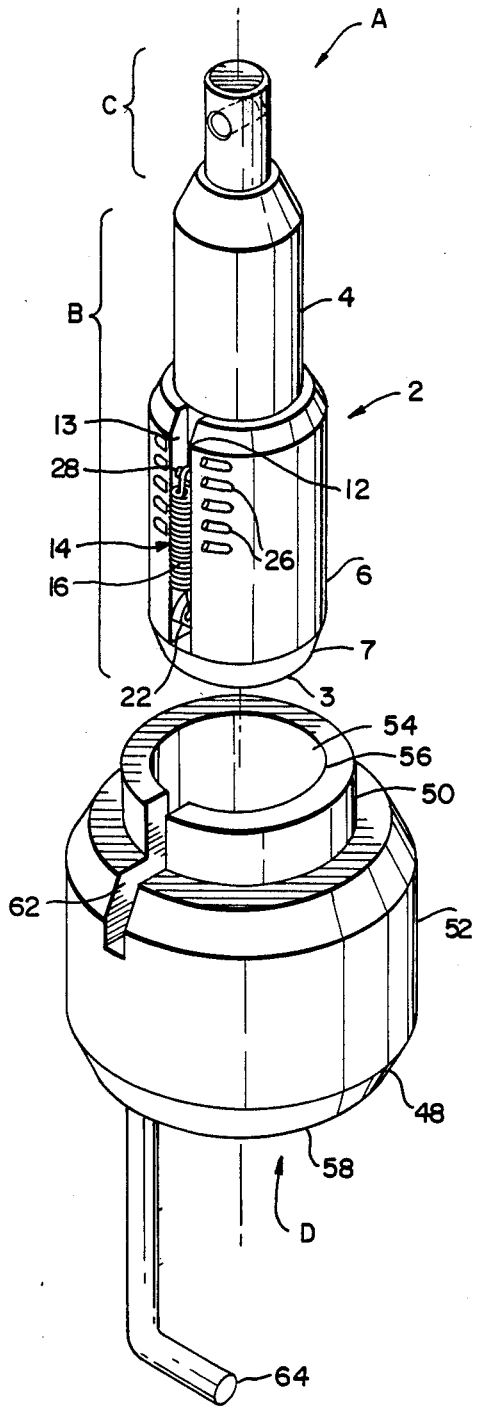
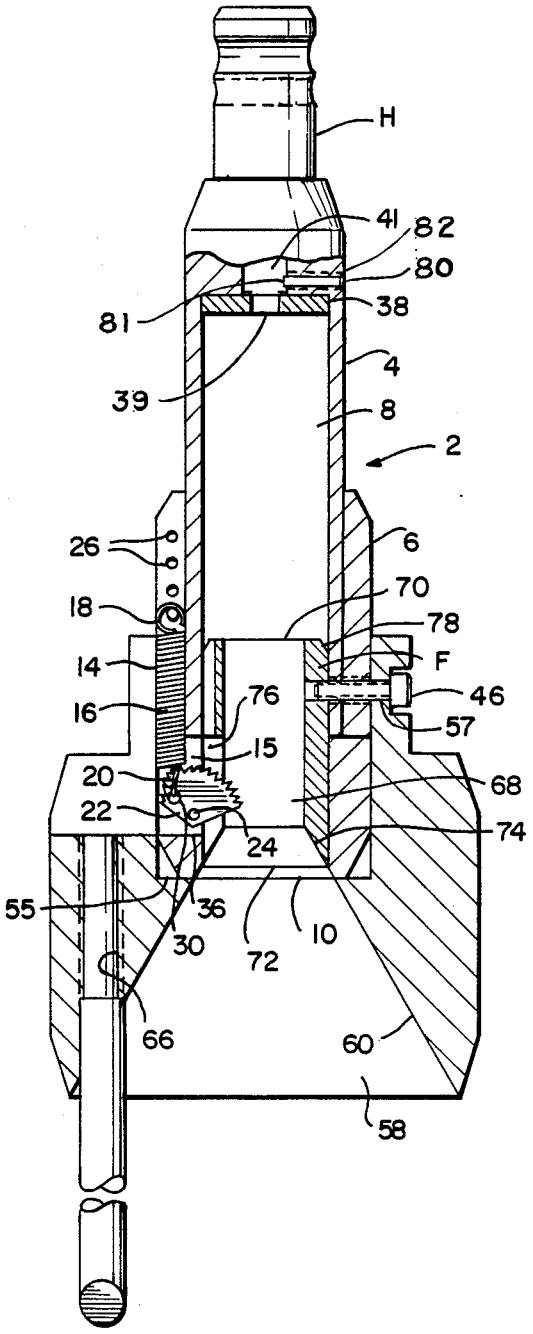
FIG 2

ICE AUGER EXTRACTOR FOR RETRIEVING AUGERS OR SIMILAR DEVICES FROM A BORE HOLE

STATEMENT OF GOVERNMENT INTEREST

The invention described and claimed herein may be manufactured and used by or for the Government of the United States of America for governmental purposes without the payment of royalties thereon or therefor.

BACKGROUND AND FIELD OF THE INVENTION

The present invention relates to an ice auger extractor for retrieving augers or similar devices which have become accidently disconnected, fallen, or lodged in a bore hole.

Conventionally, a lost auger is extracted from a bore hole by fishing the auger with a line and a field fabricated hook. However, this method is time consuming and not always successful in that it often results in the loss of the auger, the core sample, and valuable field time. Various devices for retrieving an auger or similar devices from a bore hole have been proposed, as described below.

U.S. Pat. No. 2,067,009 (Hinderliter) discloses a fishing socket for retrieving pipes and sucker rods, wherein two spring-biased wedging devices 12 and 13 are slidably carried on a strip 24. The strip is detachably secured to the interior of cylindrical member 10, the interior passage of which is tapered. The wedging devices 12 and 13 are used to accommodate different-sized objects to be retrieved.

U.S. Pat. No. 1,634,935 (Donnelly) discloses a lift for sucker rods, pipes and the like. The lift includes a spring-biased body having two arms 6, which engage a collar or large portion of the pipe or rod to be lifted.

U.S. Pat. No. 2,410,262 (Breaux) discloses a device similar to the retrieval lift of Donnelly with the exception that dogs 19 are biased by a helical spring 15 extending along the longitudinal axis of the device. As shown in FIGS. 3 and 8, projections 22 of dogs engage under the coupling 23 of a stuck pipe 24.

U.S. Pat. No. 2,076,837 (Grimmelsman) discloses a core catcher for use in a core barrel or well core drill. As shown in FIG. 6, the catcher includes spring-biased dog assemblies 31 and serrated gripping elements 32, which are adjustable along the longitudinal axis of the catcher.

U.S. Pat. No. 2,103,611 (Catland et al) discloses a core catcher which includes spring-biased dog assemblies 33 and wedge-like gripping parts 35 which are adjustable along the longitudinal catcher structure.

U.S. Pat. No. 2,595,008 (Still) discloses a tool for use in gripping and pulling broken pipes from oil or like deep wells. The extractor includes a cylindrical roller or shaft 16 with a knurled surface for engaging the surface of the broken pipes.

U.S. Pat. No. 1,754,816 (Canniff) discloses a sucker rod socket for retrieving broken sucker rods or like objects from a well. The device includes a gripping ring 15 loosely mounted in the bore of the device. Gripping ring 15 includes an inner concave wall 22 which has bevelled edges or annular teeth 25 for gripping a sucker rod.

U.S. Pat. No. 1,487,440 (Butts) discloses a fishing pole which includes gripping dogs 16 disposed about the internal periphery of the tool. The lower edges of the dogs, when arranged in the canted position shown in FIG. 1, provide biting teeth 19 for engaging the outer surface of the device being recovered.

U.S. Pat. No. 1,352,172 (Brandon) discloses a drill retriever which includes a plurality of ring receiving sockets 13 adapted to receive a plurality or rings of washer members 16. The rings or washer members assume angular position shown in FIG. 6, thereby causing the bore opening walls to frictionally engage the sides of the drill to be retrieved.

U.S. Pat. No. 3,326,566 (Boyd) discloses a fishing tool which includes a plurality of pawls or dogs 17. As shown in FIGS. 1–3, the dogs include serrated edges for gripping the external surface of the sucker rod to be retrieved.

SUMMARY OF THE INVENTION

It is an object of the present invention to provide an ice auger extractor which can be used to retrieve augers or similar devices which have accidently become disconnected, fallen or lightly lodged in the walls of a bore hole.

It is another object of the present invention to provide an ice auger extractor which is easily adaptable to different bore holes of different sizes.

It is yet another object of the present invention to provide an ice auger extractor which does not require the use of a line and/or a field fabricated hook and can be easily utilized in the field.

It is a further object of the present invention to provide an ice auger extractor which is adaptable to different rod sizes, different bore hole sizes and different gripping ranges.

Another object of the present invention is to provide an ice auger extractor which is adapted to grip the smooth surfaces of cylindrical rods formed of various materials.

It is another object of the present invention to provide an ice auger extractor which is adapted to extricate and center a rod which has an end embedded in the wall of the bore hole.

It is yet another object of the present invention to provide an ice auger extractor which requires a small number of parts and is easy to assemble and use.

It is another object of the present invention to provide an ice auger extractor which is adaptable and is easily modified with interchangeable parts from a kit to operate in various situations.

It is yet another object of the present invention to provide an ice auger extractor in which the material of various parts can be varied without any or negligible effect on the operation of the device.

It summary, the disclosed invention provides an ice auger extractor for retrieving augers or similar devices from a bore hole, and which has the ability to extricate and center a rod having a free end embedded in the wall of a bore hole.

DESCRIPTION OF THE DRAWINGS

The above and other objects and advantages and novel features of the present invention will become apparent from the following detailed description of the preferred embodiment of the invention illustrated in the accompanying drawings, in which:

FIG. 1 is an exploded perspective view of a first embodiment of an ice auger extractor according to the present invention;

FIG. 2 is a longitudinal cross-sectional view of the ice auger extractor of FIG. 1;

DETAILED DESCRIPTION OF THE INVENTION

Figure 5:
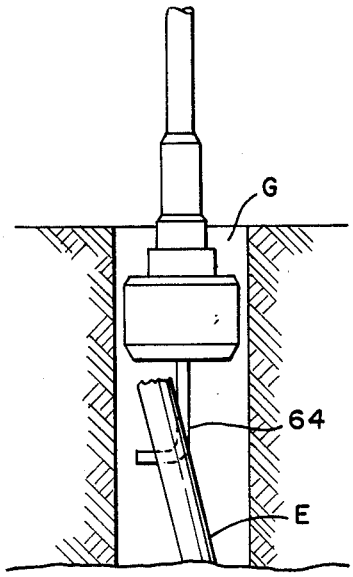
FIGS. 5–7 illustrate use of the ice auger extractor of FIG. 1 in extracting an auger embedded in the wall of the bore hole.
Figure 6:
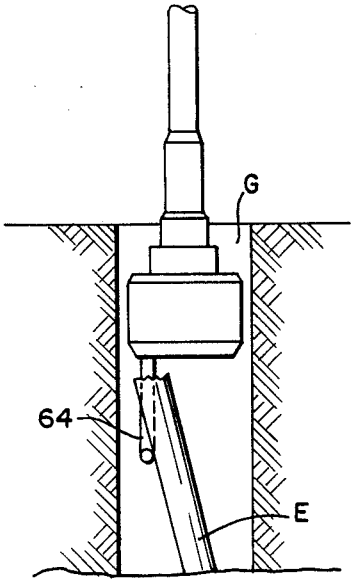
Figure 7:
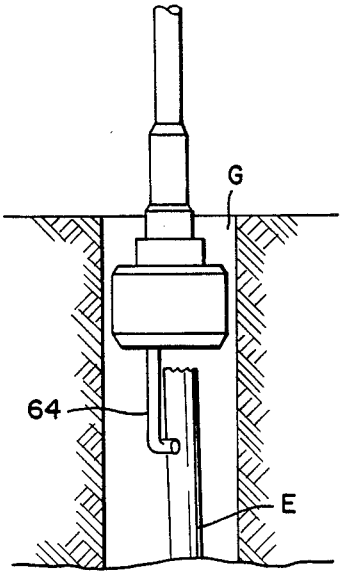

As best shown in FIG. 1, ice auger extractor A includes a lower main body portion B and an upper rod adapter C for accommodating various types of drive assemblies which may be used in the field. In an alternative embodiment, bore adapter D may be connected with the auger extractor A for centering an auger rod, as shown in FIGS. 5–7.

The main body portion B is a longitudinal housing 2 having an upper section 4 and a lower section 6. The housing 2 includes a bore 8 which extends along the longitudinal axis of the housing and has an opening 10 in lower section 6 thereof. As shown in FIGS. 1 and 2, the external diameter of the lower section 6 of the housing 2 is greater than the external diameter of the upper section 4. However, the diameter of bore 8, which extends from upper section 4 through lower section 6, remains constant throughout the length thereof.

The lower section 6 includes a recess 12 which extends longitudinally parallel to the axis or bore 8 in a peripheral portion thereof. As best seen in FIG. 2, recess 12 includes a vertical portion 13 and a horizontal base portion 15 and is substantially L-shaped and receives a detent or latching mechanism 14 for catching or gripping an auger rod E. The detent or latching mechanism 14 includes a cam 22 and an extension spring 16 having end hooks 18 and 20 biased thereto. The latching mechanism 14 is positioned in the recess 12 such that the spring 16 extends in vertical portion 13 of recess 12, and cam 22 is pivotable about dowel pin 24 in the base portion 15 of recess 12. The vertical portion 13 of the recess 12 includes a number of vertically spaced holes 26 located on either side thereof for receiving a securing rod 28 therein. Holes 26 open to the exterior surface of the housing 2, so that securing rod 28 can be easily inserted or taken out by using an elongated pin or the like (not shown). The end-hook 18 of extension spring 16 is secured to the securing rod 28 and the end-hook 20 is secured in hole 30 of cam 22. Therefore, cam 22 pivots either clockwise or counterclockwise about pin 24, thereby compressing or extending the spring 16. As one of ordinary skill in the art will appreciate, positioning securing rod 28 into a different set of holes 26 varies the force exerted by the spring 16 on cam 22.

Figure 3:
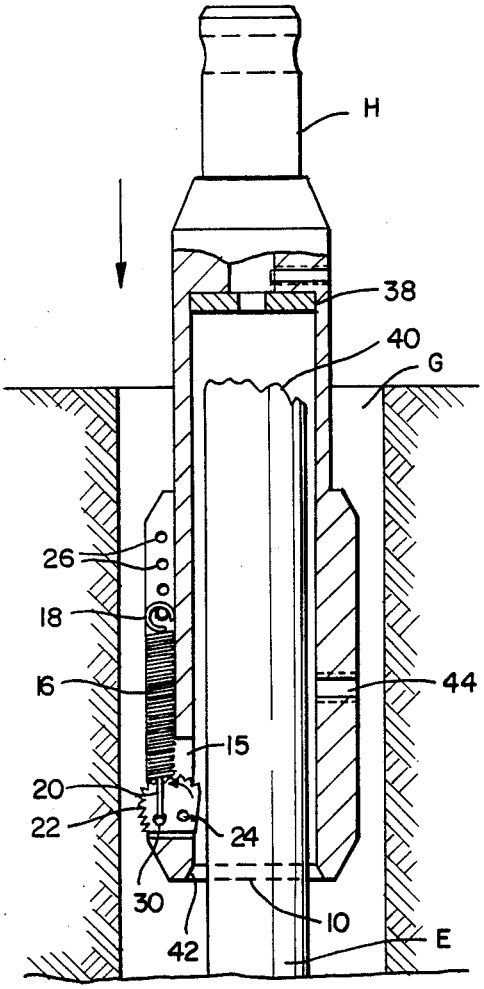
FIG. 3 is a longitudinal cross-sectional view of a second embodiment of the ice auger extractor as it is being lowered into a bore hole.
Figure 4:
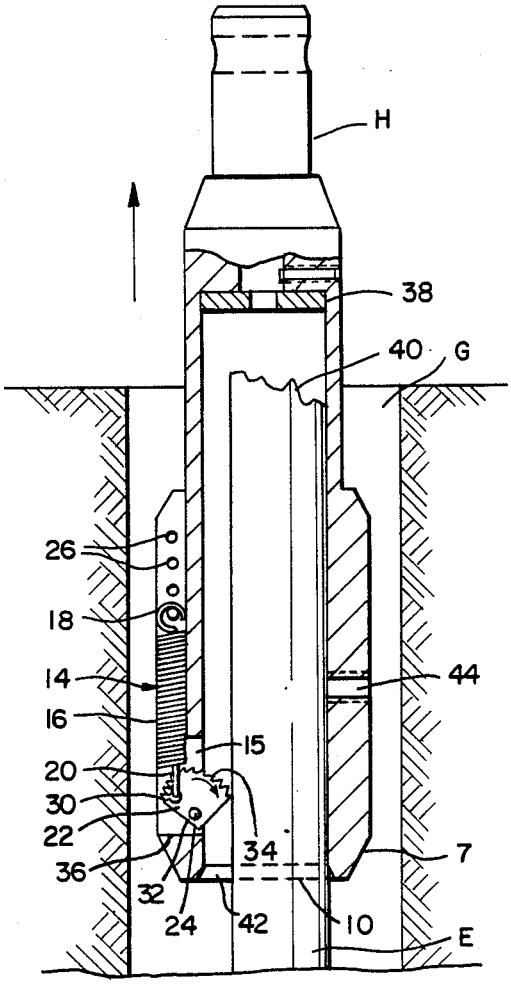
FIG. 4 is a longitudinal cross-sectional view of the ice auger extractor of FIG. 3 showing an auger rod being extracted.

The cam 22 includes cam edges 32 and 34. As shown in FIG. 4, cam edge 34 is serrated for engaging the surface of auger rod E. As shown in FIG. 3, counterclockwise movement of cam 22 causes the cam edge 32 to come to rest on surface 36 of recess 12, thereby forcing rod 40 to farside of bore 8. Recess surface 36, therefore, functions as a stop for cam 22 during counterclockwise movement thereof.

A ring 38, made from a resilient material, is positioned within the bore 8 in the upper section 4 of housing 2 as best shown in FIG. 2. The ring 38 functions as a cushion for the broken end 40 of auger rod E and further acts as a spring to facilitate easy removal of the auger rod E from the device A. The hole 39 of the resilient ring 38 communicates with neck opening 41 of upper section 4 of housing 2. The neck opening 41 is open to the exterior and is provided for ease of cleaning the bore 8 which may become clogged with snow or other field-material.

As shown in FIGS. 3 and 4, opening 10 of housing 2 includes a frusto-conical surface 42 for guiding the auger rod E towards the center of extractor A. As shown in FIGS. 3 and 4, lower section 6 of housing 2 includes a transversely extending screw-threaded hole 44 for receiving screw 46 when bore adapter D is connected with main body portion B of the extractor A. (See FIG. 2). Although screw-threaded hole 44 is shown to be located radially opposite to recess 12, one of ordinary skill will appreciate that the positioning of recess 12 and screw-threaded hole 44 can be varied.

BORE ADAPTER

As shown in FIGS. 1 and 2, bore adapter D includes sleeve 48 having an upper portion 50 and a lower portion 52. The diameter of the upper portion 50 is less than the diameter of the lower portion 52. Sleeve 48 is open at both ends and includes a bore 54 extending therethrough. Upper opening 56 of bore 54 is adapted to receive the lower section 6 of housing 2 therein. As shown in FIG. 2, lower opening 58 of the bore 54 includes a frusto-conical surface 60 for guiding the auger rod E toward the center thereof. Sleeve 48 further includes a vertically extending recess 62 which is formed in a peripheral portion thereof. Recess 62 of sleeve 48 is aligned with recess 12 of housing 2 such that when the lower section 6 of the housing 2 is received in bore 54 of bore adapter D, a portion of the detent or latching mechanism 14 extends into recess 62. An L-shaped snagging hook 64 extends downwardly from hole 66 formed in a peripheral portion of the sleeve 48.

The upper portion 50 of sleeve 48 includes a transversely extending orifice 57 which is aligned with screw-threaded hole 44 so that screw 46 may be positioned therein for holding main body portion B in tight non-rotatable engagement with bore adapter D.

As shown in FIG. 2, an adapter sleeve F having an external diameter corresponding to the diameter of bore 8 may be inserted into lower section 6 of housing 2 for decreasing the internal diameter of the bore 8. Adapter sleeve F is attached to main body portion B via screw 46. This adapter may be used with or without bore adapter D. This construction allows the ice auger extractor A to retrieve a very thin auger rod. By inserting various adapter sleeves having varying internal diameter, the effective diameter of bore 8 can be varied to thereby allow the retrieval of auger rod of varying diameters.

As shown in FIG. 2, the adapter sleeve F has a bore 68, the upper opening 70 of which communicates with the interior of housing 2 and the lower opening 72 of which is aligned with opening 10 of housing 2. The lower opening 72 of adapter sleeve F includes a frusto-conical surface 74 which is aligned with the frusto-conical surface 42 of housing 2 and the frusto-conical surface 60 of bore adapter D. In this way, a continuous frusto-conical surface is formed which guides the ice auger toward the center of the extractor A.

Adapter sleeve F includes a vertically extending opening 76 which is aligned with the lower base portion opening 15 of housing 2. Therefore, when cam 22 pivots, a portion of cam 22 extends through recess 76 and into bore 68. The upper edge 78 of adapter sleeve F is tapered to facilitate insertion into the bore 8 of the housing 2.

The bore adapter D further includes a platform 55 for resting the lower end 3 of housing 2 thereon.

The lower end 3 of housing 2 includes inwardly inclined surface 7 for the easy insertion of the housing into bore 54 of the sleeve 48.

Various rod adapters H can be connected to the main body portion B of the extractor A through the use of a set screw 80 which locks on the shank 81 of the adapter H in bore 41 of upper section 4 through screw thread 82.

OPERATION

In operation, the ice auger extractor A is lowered into a bore hole G to retrieve the auger rod E which has become accidently disconnected, fallen or lodged therein. As best seen in FIG. 3, as the auger rod E makes its way into bore 8 of housing 2, the cam 22 rotates counterclockwise (shown by arrow in FIG. 3) from its initial position shown in FIG. 2. As the cam 22 rotates counterclockwise, the extension spring 16 is pulled downwardly and due to the exerted compression force, applies an upwardly and radially extending force for causing the cam 22 to engage the outer surface of the auger rod E. This furthermore causes the rod E to shift radially relative to adapter A so that the rod E engages the wall provided by bore 8 or bore 68. Once the auger rod E has travelled a sufficient distance into the bore 8 of housing 2, the extractor A may then be gently lifted as shown in FIG. 4. Preferably, the end 40 engages ring 38 before lifting is begun. During lifting of the extractor A, the auger rod E tends to slide downwardly due to the gravitational force, however, cam 22 rotates clockwise (shown by arrow in FIG. 4) due to the compression force exerted by the spring 16 and the cam edge 34 grips and frictionally holds the auger rod E within the bore 8 and against the wall thereof. Auger rod E may therefore be retreived by lifting the extractor A without fear the rod E will slip therefrom.

In the instances where the free end of rod E is embedded into the wall of the bore G, or is positioned non-concentric with the bore hole due to angular inclination or otherwise, then the L-shaped hook 64 or bore adapter D may be used to center the auger rod E relative to the coaxial bores 8, 10 and 68. As shown in FIGS. 5–7, the auger extractor A along with the bore adapter D is lowered into the bore hole G until the extension of snagging hook 64 is below end 40. Then the entire device is rotated until the auger rod E is centered. Once the auger rod E is centered and extends substantially vertically in the bore hole G, then the extractor A may be further be lowered because the frusto-conical surface 60 guides the auger rod E towards the center of the extractor A. The rod E is then locked in the bores by the spring-operated action of the detent mechanism 14 as before. Various drill rod adapters H shown in FIG. 2 can be easily installed by loosening set screw 80, removing adapter H, replacing with another adapter, and tightening set screw 80.

What is claimed is:

1. A device for retrieving an auger rod from a hole, comprising:

(a) a housing having a longitudinal axis;

(b) said housing including a first bore extending along said longitudinal axis;

(c) said housing having an exterior surface and an interior surface;

(d) said housing having a first recess formed in a portion thereof;

(e) a portion of said first recess extending through said exterior surface to said interior surface;

(f) detent means, including a cam means and a spring means biased thereto, positioned in said first recess for securing an auger rod in said housing;

(g) adapter means releasably attached to said housing for centering the auger rod on said axis, said adapter means including a sleeve having a first end and a second end, said sleeve having a second coaxial bore extending along the longitudinal axis thereof;

(h) said sleeve having a second recess adjacent said first end thereof; and (i) said second recess aligned with said first recess so that a portion of said cam means extends through said second recess.

2. The device of claim 1 wherein:

(a) said spring means comprising an extension spring;

(b) adjustable securing means operably associated with said housing for securing said spring in said first recess; and (c) one end of said extension spring being releasably attached to said cam means and another end being releasably attached to said securing means.

3. The device of claim 2, wherein:

(a) said securing means comprising a plurality of holes arranged in series on opposite sides of said first recess, and a securing member being received in cooperating ones of said holes for securing one end of said extension spring thereon.

4. The device of claim 1, wherein:

(a) said cam means comprising a cam having serrated edge; and (b) said cam being pivotally positioned in said first recess so that said serrated edge extends into said bore.

5. The device of claim 4, wherein:

(a) said adapter means and said bore having an uninterrupted continuous frusto-conical surface for centering the rod.

* * * * *